US007521616B2

(12) United States Patent
Kahler

(10) Patent No.: US 7,521,616 B2
(45) Date of Patent: Apr. 21, 2009

(54) LOCKING CAM TREMOLO DEVICE

(76) Inventor: Gary Kahler, 2525 Jason Ct., Oceanside, CA (US) 92056

( * ) Notice: Subject to any disclaimer, the term of this patent is extended or adjusted under 35 U.S.C. 154(b) by 0 days.

(21) Appl. No.: 11/534,713

(22) Filed: Sep. 25, 2006

(65) Prior Publication Data

US 2008/0072735 A1 Mar. 27, 2008

(51) Int. Cl.
*G10D 3/00* (2006.01)

(52) U.S. Cl. ..... 84/313

(58) Field of Classification Search ..... 84/312 R, 84/313

See application file for complete search history.

(56) References Cited

U.S. PATENT DOCUMENTS 4,171,661 A 10/1979 Rose
4,457,201 A * 7/1984 Storey ..... 84/313
4,487,100 A * 12/1984 Storey ..... 84/299
4,632,005 A * 12/1986 Steinberger ..... 84/313
4,742,750 A 5/1988 Storey
4,892,025 A 1/1990 Steinberger
5,986,192 A 11/1999 Wingfield et al.

* cited by examiner

*Primary Examiner*—Kimberly R Lockett
(74) *Attorney, Agent, or Firm*—Lawrence E. Laubscher, Jr.

(57) ABSTRACT

A cam tremolo device for a stringed musical instrument includes a frame secured to the instrument and a tailpiece rotatably connected with the frame and is characterized by a locking mechanism which is manually operable to prevent the tailpiece from rotating. The locking device is preferably a screw which is manually displaced by the operator relative to a threaded opening in the frame and a slot in the string attachment device connected with the tailpiece. When the screw is rotated to a locking position, the screw advances through the frame opening into the slot in the string attachment device. When the screw is rotated to a release position, the screw is retracted from the slot in the string attachment device, thereby allowing the tailpiece to rotate relative to the frame. Thus, the tailpiece is in either a fixed or floating condition, but not both at the same time.

6 Claims, 2 Drawing Sheets

LOCKING CAM TREMOLO DEVICE

BACKGROUND OF THE INVENTION

Stringed musical instruments such as guitars typically have a fixed bridge arranged between tuning pegs at the end of the neck of the guitar and string attachment devices on the body of the guitar, with sound being generated by plucking or strumming the strings. In order to produce a vibrato effect, a tremolo device can be provided on a guitar to simultaneously alter the tension of the strings during play. Fulcrum type tremolos tip or pivot to vary the tension on the instrument strings to produce the vibrato effect. Cam type tremolos rotate to vary the tension on the strings to produce a similar effect. Typically, a handle or bar is connected with the tremolo tailpiece to assist the player of the instrument with moving the tremolo bridge to produce the desired effect. The present invention relates to a cam tremolo device which can be switched between fixed and movable conditions.

BRIEF DESCRIPTION OF THE PRIOR ART

Fulcrum and cam tremolo devices are well known in the patented prior art as evidenced by the patents to Rose U.S. Pat. No. 4,171,661 and Storey U.S. Pat. No. 4,457,201, respectively. While these devices operate satisfactorily, they are not capable of operating in a fixed condition as in the case of a traditional guitar. That is, because the tremolo component is free to pivot or rotate depending on whether it is of the fulcrum or cam design, it has a tendency to move during normal play of the instrument which alters the sound produced by the instrument.

In order to overcome this drawback, a locking mechanism has been developed for fulcrum type tremolos as shown in the Steinberger U.S. Pat. No. 4,892,025 and the Wingfield et al U.S. Pat. No. 5,986,192. Each of these devices are operable to prevent pivotal movement of the base plate of the tremolo with respect to its pivot point, typically screws or posts in the guitar body. However, the prior locking devices are not suitable for use with cam type tremolos. The present invention was developed in order to overcome these and other drawbacks of prior devices by providing a device for locking a rotatable cam-type tailpiece in a non-rotatable condition.

SUMMARY OF THE INVENTION

According to the invention, a combined cam tremolo and bridge assembly includes a frame containing a central recess and a cam-type tailpiece which is rotatably connected with the frame. The tailpiece preferably has an L-shaped configuration with the horizontal portion thereof being arranged within the central recess of the frame. The axis of rotation is at the top of the vertical portion so that the tailpiece operates as a cam. A string attachment device is connected with the tailpiece horizontal portion and a bridge is connected with the frame in front of the tailpiece to guide the strings to the string attachment device. A locking device is connected between the frame and string attachment device and is operable between a locked position which prevents the tailpiece from rotating relative to the frame and a released position which allows the tailpiece to rotate.

According to a preferred embodiment, the locking device is a screw which passes through a threaded opening in the frame. Rotation of the screw in a locking direction advances the screw to engage the string attachment device. Rotation of the screw in a release direction retracts the screw from the string attachment device so that the tailpiece on which the string attachment device is mounted is free to rotate relative to the frame.

The bridge includes a plurality of adjustable saddles, one for each string. In addition, the string attachment device is independently adjustable for each string to selectively vary the tension of each string.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
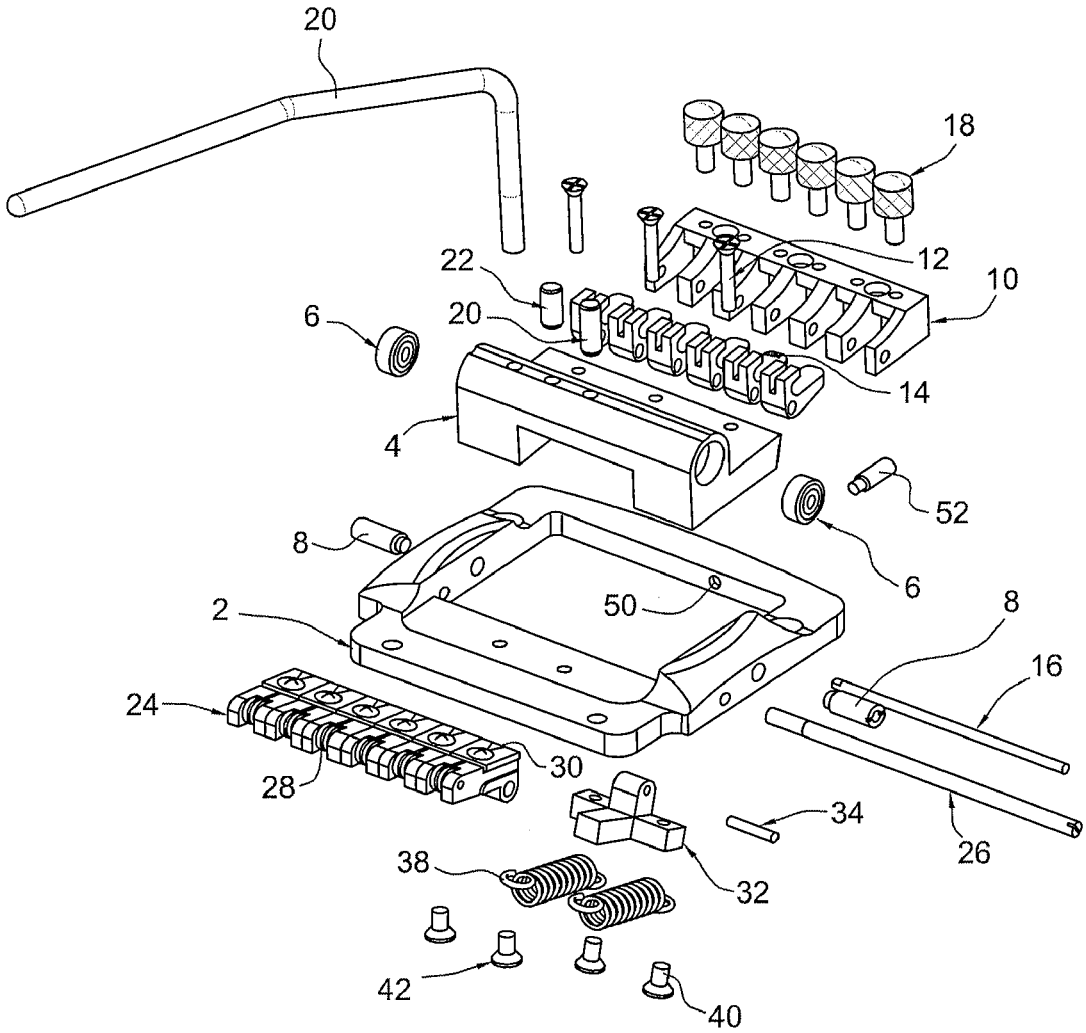
FIG. 1 is an exploded view of a tremolo device according to the invention.

Referring first to FIG. 1, a combined bridge and cam tremolo device according to the invention will be described. The cam tremolo is similar to that disclosed in the Storey U.S. Pat. No. 4,457,201. The device includes a frame 2 which is mounted on a stringed musical instrument such as a guitar using screw, bolts or the like. The frame includes a central recess in which a tailpiece 4 is arranged. The tailpiece is connected with the frame via bearings 6 so that the tailpiece rotates with respect to the frame. The bearings are held in place by set screws 8. In a preferred embodiment, the tailpiece has an L-shaped configuration with the bearings being connected with the frame at the top portion of the tailpiece to provide a cam like operation. That is, the longitudinal axis of rotation of the tailpiece is eccentrically horizontally and vertically offset from the longitudinal axis of the tailpiece, thereby to provide camming action relative to the frame during rotation of the tailpiece.

Mounted on the horizontal portion of the tailpiece is a string attachment cage 10. The cage is connected with the tailpiece by screws 12 or other fasteners in a known manner so that the cage rotates with the tailpiece relative to the frame. A plurality of hooks 14 are pivotally connected with the cage via a pin 16 which passes through aligned openings in the hooks and cage. Each hook is adapted to receive the ball end of one of the strings of the musical instrument in a known manner. A plurality of thumb screws 18 pass through threaded openings in the cage and have ends which abut against respective hooks. Rotation of the screws 18 allows the hooks to be pivoted individually to selectively alter the tension of the associated string. In order to rotate the tailpiece, a handle 20 is connected therewith. The player of the instrument pushes or pulls on the handle to rotate the tailpiece to simultaneously alter the tension of the instrument strings to produce a vibrato effect while the instrument is being played. Set screws 22 in the tailpiece control the amount of play in the handle relative to the tailpiece.

A bridge is connected with the frame in front of the tailpiece. According to the preferred embodiment of the invention, the bridge comprises a plurality of adjustable bridge saddles 24 which are rotatably connected with the frame via a mounting pin 26. There is one bridge saddle for each instrument string. Each saddle includes a roller 28 for supporting the respective string. The saddles are adjustable laterally relative to the pin 26 and vertically relative to the frame by adjustment screws 30.

Figure 2:
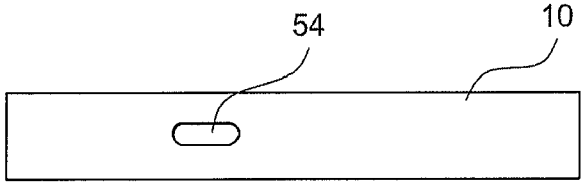
FIG. 2 is a rear plan view of a string attachment cage according to the invention.

A tension lever 32 is pivotally connected with the lower horizontal portion of the tailpiece via a pin 34 arranged in a slot 36 of the tailpiece as shown more particularly in FIG. 2. A pair of springs 38 are connected at one end with the lever 32 via screws 40. The other ends of the springs 38 are connected with the frame 2 via screws 42. The springs normally bias the tailpiece for rotation in a direction opposite to the direction of rotation of the tailpiece induced by the tension of the instrument strings which are connected at a far end of the instrument such as at an end of the neck. FIG. 2 also shows openings 44 at opposite ends in the top of the tailpiece for receiving the handle 20 depending on whether the operator of the tailpiece is right or left handed. Openings 46 receive the set screws 20, 22 and openings 48 receive the screws 12 for the cage 10 of FIG. 1.

Figure 3:
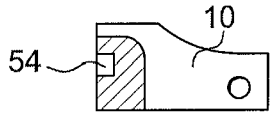
FIG. 3 is a partial sectional side view of the cage of FIG. 2.

In a normal condition, the tailpiece of the cam tremolo device of FIG. 1 is free floating as determined by the opposed tension forces of the springs 38 and the instrument strings. This allows the tailpiece to be rotated by the player of the musical instrument to simultaneously alter the tension of the strings to produce a vibrato effect on the instrument strings. In order to lock the device in a fixed, non-rotational condition, a locking mechanism is provided. The frame 2 includes a threaded opening 50 in a rear portion thereof for receiving a locking screw 52. As shown more particularly in FIGS. 2 and 3, the string attachment cage 10 contains a slot 54 which is aligned with the frame opening 50. Rotation of the locking screw 52 in a locking direction advances the screw through the frame opening and into the slot in the string attachment cage. With the cage so engaged, the tailpiece with which the cage is connected is prevented from rotating and is thus locked in position. This results in a fixed bridge configuration for the device. Rotation of the screw in a release direction retracts the screw from the slot 54 in the cage 10, releasing the tailpiece for rotation relative to the frame. In lieu of a slot, the cage may contain a threaded opening for receiving the screw 52 in the locking position. It is also possible to provide a cage without a recess or opening, in which case the forward end of the screw merely abuts against the cage with sufficient force to lock it and the tailpiece into a non-rotational condition.

The locking mechanism according to the invention therefore allows the tailpiece of the cam tremolo device to be in either a fixed or floating condition, but not both at the same time. The locking mechanism is manually operated, not automated. Preferably, the screw 52 has a head adapted for receiving an Allen wrench which is used to manually operate the screw. Owing to the tolerances between the screw 52, the frame threaded opening 50, and the cage slot 54, a secure locking mechanism is provided which will not shift between locking and released conditions without manual operation of the screw via an Allen wrench by the operator.

Figure 4:
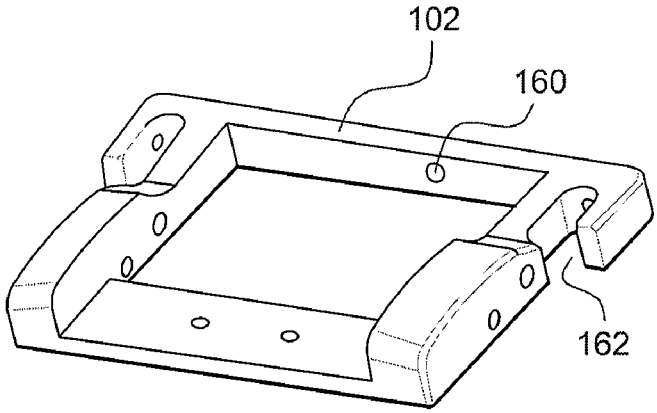
FIG. 4 is a perspective view of an alternate frame for the device of FIG. 1 which is used for stud mounting the tremolo on a musical instrument.
Figure 5:
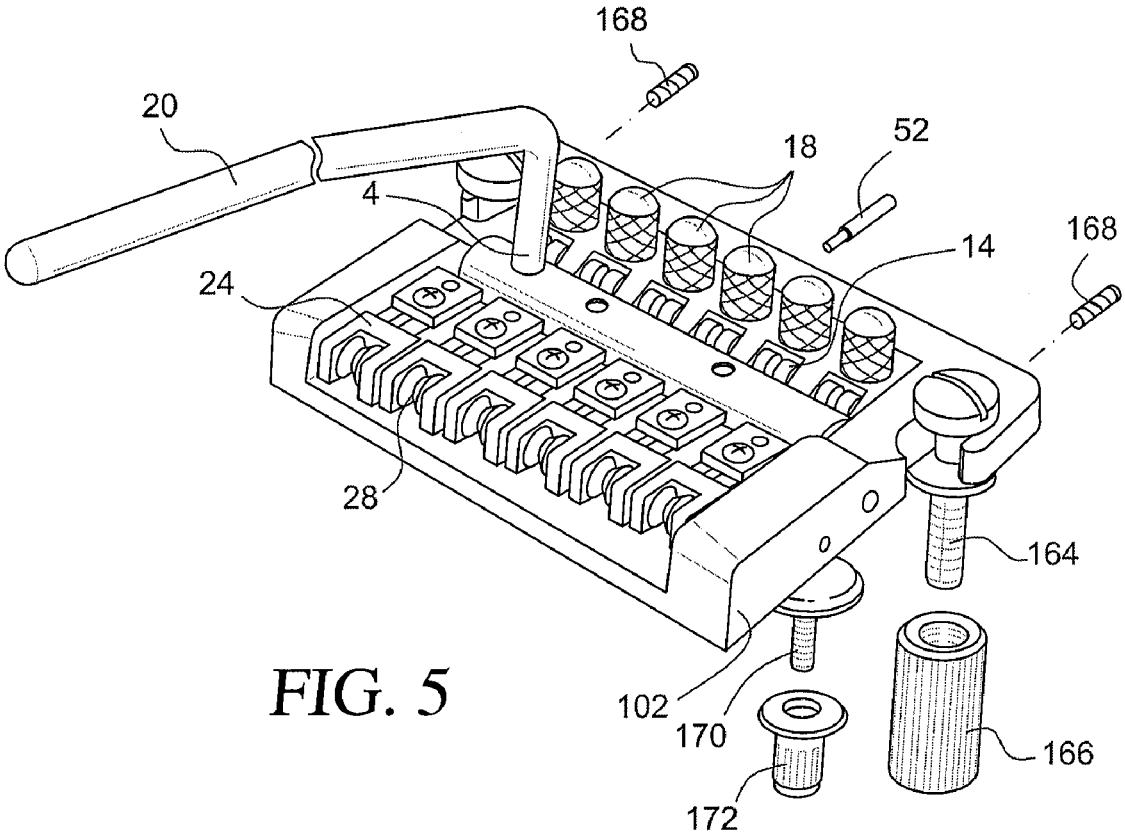
FIG. 5 is a perspective view of the tremolo device in its assembled condition.

An alternate frame 102 for the cam tremolo device according to the invention is shown in FIG. 4. This frame is for a stud-mount connection with the musical instrument. The frame is similar to the frame 2 of FIG. 1 in all respects for connection of a string attachment cage, an adjustable bridge and tension springs and includes a threaded opening 160 for a locking screw. The difference between the frames is that the frame 102 includes slots 162 for receiving studs 164 as shown in FIG. 5. The studs are threadably connected with stud mounts 166 anchored in the body of the musical instrument. Screws 168 are provided to secure the frame adjacent to the studs. The forward portions of the frame 102 slide on auxiliary studs 170 having domed upper portions. The auxiliary studs are pressed into auxiliary sleeves 172 arranged in the instrument body.

While the preferred forms and embodiments of the invention have been illustrated and described, it will be apparent to those of ordinary skill in the art that various changes and modifications may be made without deviating from the inventive concepts set forth above.

What is claimed is:

1. A cam tremolo device for a stringed musical instrument, comprising (a) a frame containing a central recess;

(b) a tailpiece comprising a cam member and having an L-shaped configuration arranged within said frame recess and rotatably connected with said frame;

(c) a string attachment device connected with a horizontal portions of said tailpiece;

(d) at least one spring connected between said cam member and said frame for biasing said cam member in a direction of rotation opposite to the direction of rotation of said cam member induced by tension on the instrument strings; and (e) a locking device connected between said frame and said string attachment device and manually operable between a locked position which prevents said tailpiece from rotating relative to said frame and a released position which allows said tailpiece to rotate.

2. A cam tremolo device as defined in claim 1, wherein said frame contains a threaded opening and said locking device comprises a screw which when rotated in a locking direction passes through said threaded opening to engage said string attachment device and when rotated in a release direction retracts from engagement with said string attachment device.

3. A cam tremolo device as defined in claim 2, wherein said string attachment device contains a slot aligned with said frame threaded opening to receive said screw when said locking device is in the locked position.

4. A cam tremolo device as defined in claim 2, and further comprising a bridge connected with said frame for guiding the instrument strings to said string attachment device.

5. A cam tremolo device as defined in claim 4, wherein said bridge comprises a plurality of adjustable saddles.

6. A cam tremolo device as defined in claim 1, wherein said string attachment device is independently adjustable to vary the tension of each of the instrument strings.

* * * * *